US005341879A

United States Patent [19]

Stone

[11] Patent Number: 5,341,879

[45] Date of Patent: Aug. 30, 1994

[54] FINE FILTRATION SYSTEM

[76] Inventor: William B. Stone, 3401 E. 84th Pl., Tulsa, Okla. 74137

[21] Appl. No.: 36,186

[22] Filed: Mar. 23, 1993

[51] Int. Cl.[5] ..... E21B 43/267

[52] U.S. Cl. ..... 166/278; 166/308

[58] Field of Search ..... 166/278, 308, 51, 271

[56] References Cited

U.S. PATENT DOCUMENTS 3,933,205 1/1976 Kiel ..... 166/281 X
4,044,832 8/1977 Richard ..... 166/278
4,549,608 10/1985 Stowe et al. ..... 166/278 X
4,685,519 8/1987 Stowe et al. ..... 166/280 X
4,700,777 10/1987 Luers ..... 166/57 X
4,850,430 7/1989 Copeland ..... 166/276
4,969,523 11/1990 Martin ..... 166/278

*Primary Examiner*—William P. Neuder
*Attorney, Agent, or Firm*—Gunn, Lee & Miller

[57] ABSTRACT

An apparatus and improved method for removing fines or small particles from a particle and liquid mixture, finding particular application in the field of oil and gas well gravel packing and fracturing processes.

2 Claims, 5 Drawing Sheets

FINE FILTRATION SYSTEM

BACKGROUND OF THE INVENTION

1. Field of the Invention

Applicant's invention relates to an apparatus and method to remove fines or small particles from the liquid and particulate mixture used in fracturing or gravel packing a subterranean well.

2. Background Information

Gravel packing a subterranean well addresses the problem encountered by many oil and gas producers; namely, sand flow into the well bore from unconsolidated formations. Sand flow can gradually fill the well bore until production perforations are covered, resulting in decreased production, if not total loss of production. Sand flow also damages equipment. Gravel packing eliminates, or at least reduces to trace amounts, sand flow from unconsolidated formations by placing a filtering system within the well and formation.

The concept of gravel packing is fairly simple. A screen of a pre-selected size is placed inside the well casing adjacent to the producing formation. If well casing is not used, a screen of pre-selected size is hung from the well bore adjacent to the producing formation. A mixture of a premeasured gravel packing particulates and a carrier liquid, such as water or material of similar density, is forced down the well bore under sufficient pressure and volume to deposit the gravel packing particulates against the face of the producing formation and the screen. Thus, creating an avenue through which the oil or gas being produced may travel without interruption to the well bore. The gravel packing particulates used are sized by the oil and gas industry as 20–40, 40–60, etc., grain size (U.S. Sieve) in inches of grain diameter. For example, a 20–40 grain size mixture (U.S. Sieve) contains grain sizes of 0.031" to 0.0165".

In conventional day gravel packing procedures, extreme care is used to initially choose the proper size of gravel packing particulates, and to assure that the particulates are not damaged before use; for example, during shipment to the well site or while being fed into the mixer. Yet, even though the particles are chosen for their size and carefully placed in the mixer, these same particles are forced under at least 50 psi of pressure out of the mixer and at least 1,500 psi of pressure from a high pressure, high volume pump into the well bore. In effecting this type of pressure, the opening and closing of the inlet and outlet valves of the mixer and pump crush some of the gravel packing particulates, producing fines (smaller particles) which clog the avenues created by the undamaged gravel packing particulates, and in turn cause production to decrease.

Fines are also created during the fracturing process. Generally, fracturing is another method used to increase production. Fracturing a well is accomplished by forcing a liquid and particulate mixture down the well bore to open up a new production zone. Just as in gravel packing, the particulates are chosen for their size and shape. Yet, mixers and high pressure, high volume pumps are also used in the fracturing process. Thus, fines are again created by the opening and closing of the inlet and outlet valves of the pump and mixer. Consequently, just as in gravel packing, the avenues created by the fracturing process are also clogged by fines which in turn reduce production. Therefore a need exists for a method and apparatus for removing fines that are created by the inlet and outlet valves of the mixer, pump and other equipment that the particulates come in contact with during the gravel packing or fracturing processes.

SUMMARY OF THE INVENTION

This invention finds great utility in conjunction with gravel packing or fracturing a subterranean well. In accordance with this invention, a fine filtration system is placed in the flow line after the high pressure pumps used in fracturing and gravel packing a subterranean well. This placement of the fine filtration system assures that the fines produced by the inlet and outlet valves of the mixer, pumps and other equipment that may damage the equipment and particulates or decrease the particulate size are removed before the particulate/liquid mixture is forced into or against the formation.

The fine filtration system described by the present invention can be used in any type of gravel packing system, as long as it is located in a flow line after the high pressure pumps. In the fracturing system, the current day method of fracturing may need to be altered so the fracturing compounds are added to the particulate/-liquid mixture after the fine filtration system. This would assure the liquid and particle mixture is not so viscous that the fines cannot be removed.

Further objects and advantages of the invention will be readily apparent to those skilled in the art from the following detailed description, taken in conjunction with the sheets of drawings.

DETAILED DESCRIPTION OF THE PREFERRED EMBODIMENT

The following detailed description is provided in order to aid those skilled in the art to practice the present invention. Even so, the following discussion should not be deemed to unduly limit the present invention, since modifications may easily be made in the procedures herein taught by one of ordinary skill in the art, without departing from the spirit or scope of the present invention. In this regard, the present invention is only to be limited by the scope of the claims dependent hereto and the equivalence thereof.

Figure 1:
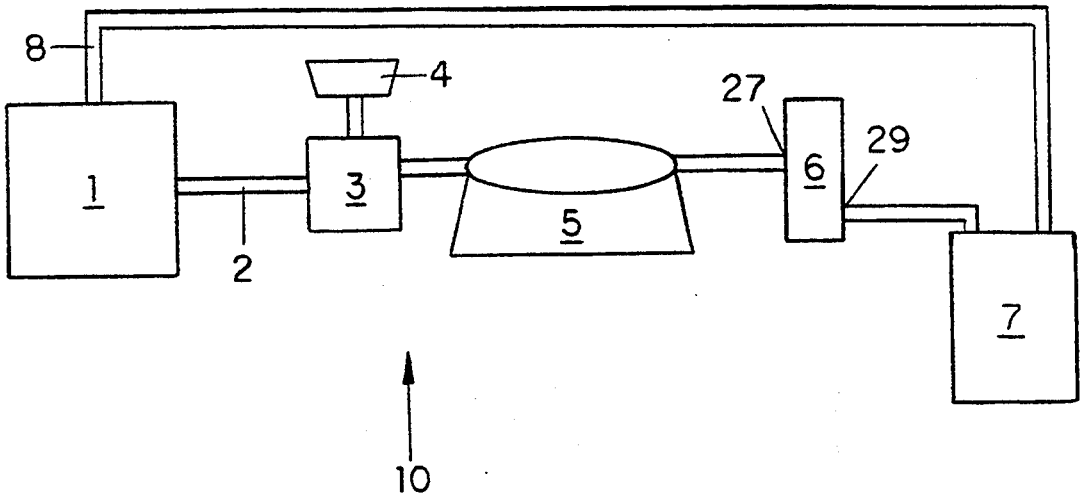
FIG. 1 is a schematic of the current day gravel packing process including the fine filtration system.

Referring to FIG. 1, there is shown a gravel packing system 10 incorporating a fine filtration system 6 of the present invention. The gravel packing fluid is maintained in tank 1. The gravel packing fluid can be water, salt water, oil, or any other liquid with a density near that of water. In the preferred embodiment, the gravel packing fluid is salt water. Tank 1 is connected by pipe 2 to combination mixer and centrifugal pump 3. Mixer and centrifugal pump 3 is used to combine the gravel packing fluid from tank 1 and the particles from particle retainer 4. The particles can be resin coated sand mixtures, ceramic bead mixtures, or sand mixtures. In the preferred embodiment, the particles are sand mixtures. Before mixing, the particles are retained in the particle retainer 4. During mixing, the particles are controllably fed into combination mixer and centrifugal pump 3. After the particles and gravel packing fluid have been blended, centrifugal pump 3 forces the mixture under low pressure, 50–100 psi, to high pressure pump 5. High pressure pump 5 exerts approximately 1,500–7,000 psi of pressure on the particle/liquid mixture to eventually force it down well bore 7. High pressure pump 5 is either a tri-plex or piston pump as described below. The only portion of FIG. 1 that is new is the incorporation and use of fine filtration system 6. The rest of the preceding discussion covers the conventional gravel packing method.

Figure 7:
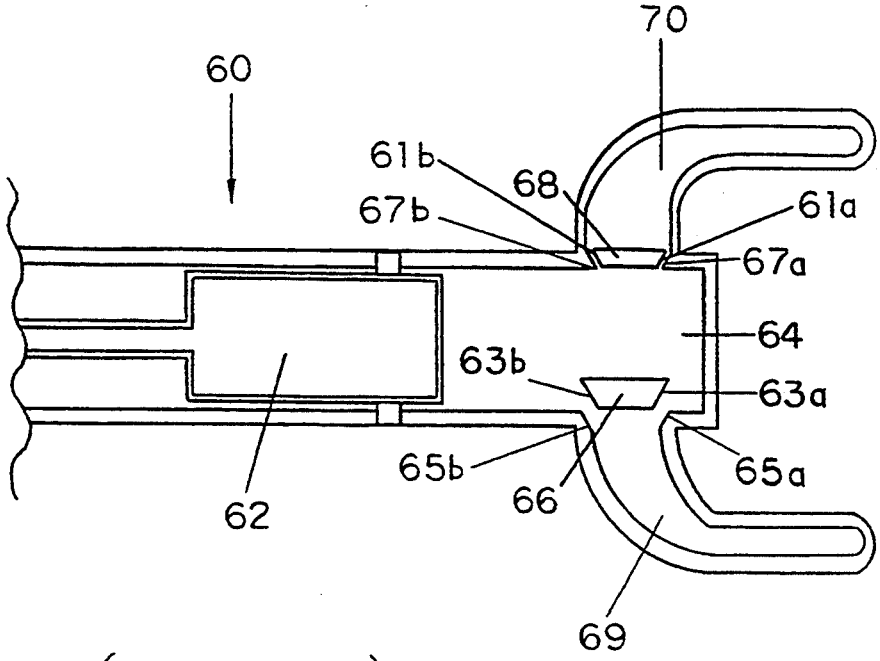
(PRIOR ART) FIG. 7
FIG. 7 is illustrative of a piston cavity in a standard tri-plex pump on its suction stroke.
Figure 8:
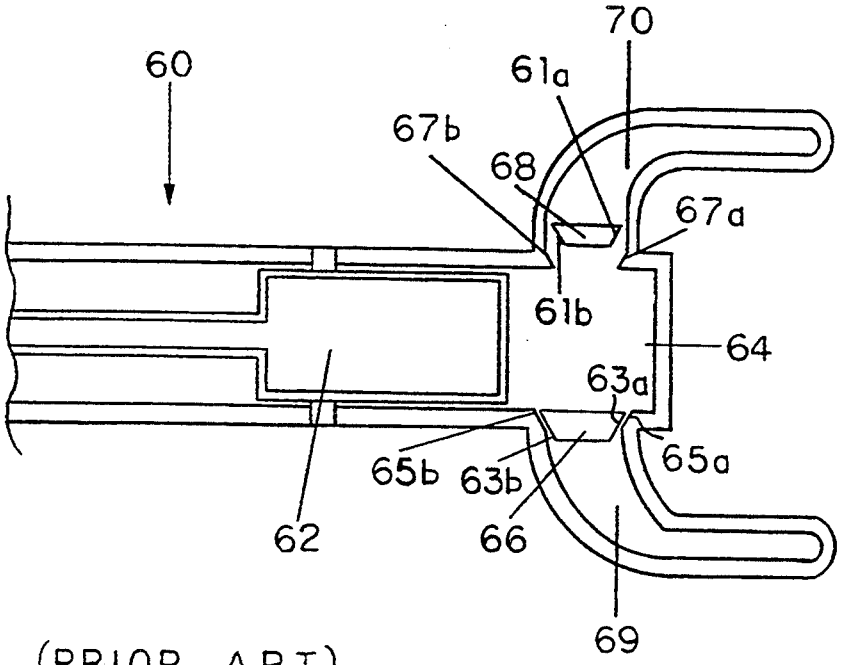
(PRIOR ART) FIG. 8
FIG. 8 is illustrative of a piston cavity in a standard tri-plex pump on its discharge stroke.

FIGS. 7 and 8 are illustrative of the workings of a tri-plex or high pressure piston pump 60. Pump 60 could be the equivalent to pumps 5 and 17 in FIGS. 1–3. However, other types of pumps could be used as pumps 5 and 17, and would cause similar creation of fines. On the suction stroke, as illustrated in FIG. 7, piston 62 is recessed in the piston cavity 64. Inlet valve 66 is open, allowing the particle/liquid mixture coming from mixer and centrifugal pump (3 in FIG. 1, 15 in FIG. 3) under up to 100 psi of pressure into piston cavity 64. Outlet valve 68 is closed.

As piston 62 moves forward through piston cavity 64 to effectuate the necessary pressure, inlet valve 66 closes and the pressure increases up to 7,000 psi inside piston cavity 64. As inlet valve 66 closes, it crushes some of the particles between valve surfaces 63*a–b* and walls 65*a–b* of inlet pipe 69 creating fines. When inlet valve 66 is reopened on the next suction stroke. The fines produced by and caught between valve surfaces 63*a–b* and wall 65*a–b* are forced into piston chamber 64.

Also, when piston 62 begins its extension into piston cavity 64, as shown in FIG. 8, outlet valve 68 begins to open and the particle/liquid mixture is forced from piston cavity 64 at up to 7,000 psi of pressure. As piston 62 recesses out of the piston cavity 64, outlet valve 68 closes. Just as occurred when the inlet valve 66 closed, outlet valve 68 crushes some of the particles between valve surfaces 61*a–b* and walls 67*a–b* of outlet pipe 70, creating fines. When outlet valve 68 is opened again, the fines lodged between valve surfaces 61*a–b* and walls 67*a–b* are forced down well 7 in FIG. 1 and 18 in FIGS. 2–3 under up to 7,000 psi of pressure with the particle/-liquid mixture from the piston cavity 64.

Fines may also be created by the inlet and outlet valves of combination mixer and centrifugal pump 3 as well as by the action of the mixer. For example, if the mixture uses a blade type mechanism that scraps the sides of the mixer walls, some of the particles may be crushed between the blades and the mixer wall.

Therefore, even though the particles may have been meticulously sized and carefully treated before entry into the gravel packing system, the combination mixer and centrifugal pump 3 and the high pressure pump 5 damage the particles, creating fines which if not removed will clog the avenues created by the gravel packing process and thus reduce production that gravel packing seeks to improve. Consequently, referring to FIG. 1, the fine filtration system 6 is placed in gravel packing system 10 after pump 5 and before well 7, and functions to remove the fines from the mixture in a manner described in more detail below. After the mixture is forced under high pressure into well 7 and the particle/liquid mixture disperses through the zone of interest, the gravel packing fluid is pumped out of well 7 through tubing 8 and returned to tank 1.

Figure 2:
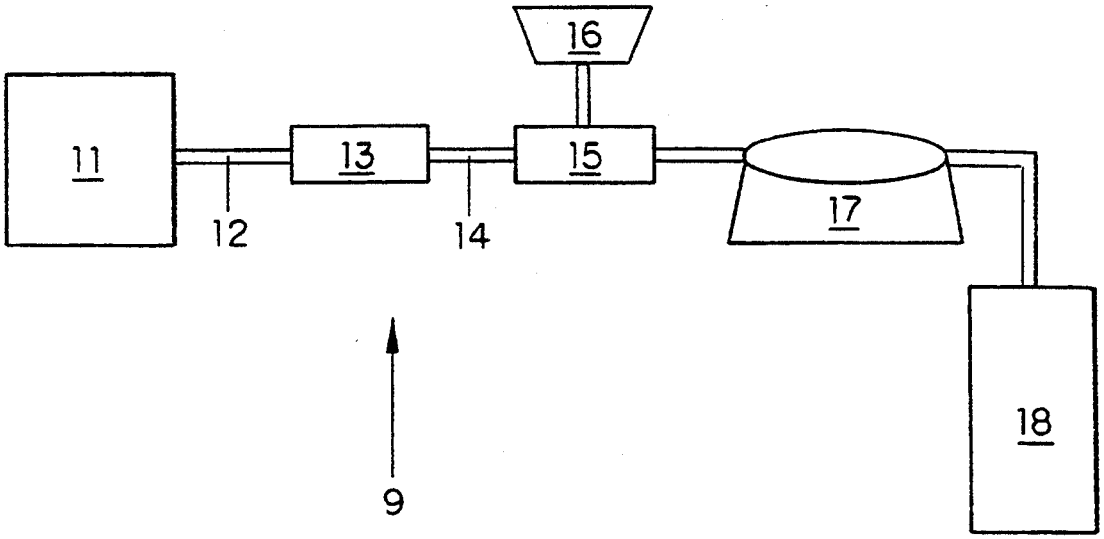
(PRIOR ART) FIG. 2
FIG. 2 is a schematic of the current day fracturing process.

A similar schematic to FIG. 1 is shown in FIG. 2, which illustrates the current day hydraulic fracturing process 9. As in FIG. 1., the fracturing process 9 shown in FIG. 2 includes tank 11 which holds the fracturing fluid. The fracturing fluid can be water or salt water. In the preferred embodiment, it is salt water combined with a bacterial agent to help avoid depositing bacteria into the well. The fracturing fluid is transported through pipe 12 into mixing area 13 wherein chemicals are added to the fracturing fluid. These chemicals can be gelling agents, refined gelling agents, or gel breakers which increase the viscosity of the entire mixture. From mixing area 13 the fracturing fluid/gel mixture is transported through pipe 14 into the combination mixer and centrifugal pump 15 wherein the fracturing particles are added from the fracturing particle retainer 16. The fracturing particles can be resin coated sand mixtures, ceramic bead mixtures, or sand mixtures. In the preferred embodiment, they are sand mixtures. The fracturing mixture is pumped out of combination mixer and centrifugal pump 15 at approximately 100 psi of pressure into high pressure fracturing pump 17. Fines are again created by both combination mixer and centrifugal pump 15 and high pressure fracturing pump 17 as was explained in the preceding paragraphs relevant to gravel packing. Consequently, just as in the gravel packing procedure discussed above, the fines that are created are not removed and thus travel into the well 18 with the fracturing mixture.

Figure 3:
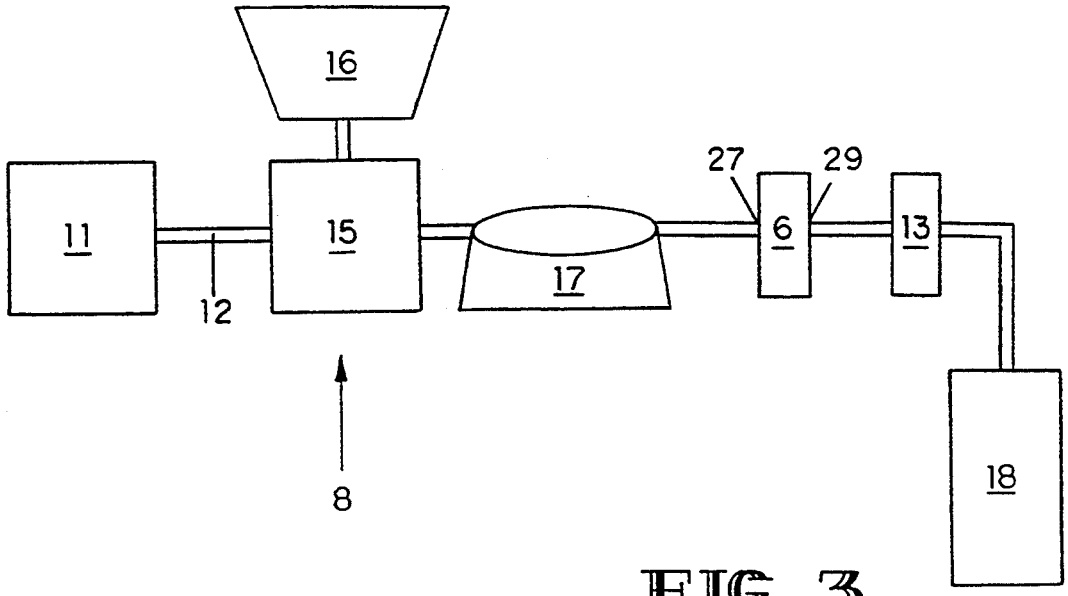
FIG. 3 is a schematic of the fracturing process in conjunction with the fine filtration system.

A schematic of fracturing process 8 incorporating the present invention is shown in FIG. 3. In FIG. 3, mixing area 13 is placed after fine filtration system 6. This change might be required if the chemicals added in mixing area 13 increase the viscosity of the fracturing mixture to a level that would inhibit the effectiveness of the fine filtration system 6. The balance of process 8 shown in FIG. 3 is arranged and functions in much the same manner as is described with respect to FIG. 2.

For the forthcoming explanations, the particle and liquid mixtures used in both gravel packing and fracturing a well will be denoted as a particle/liquid mixture.

Figure 4:
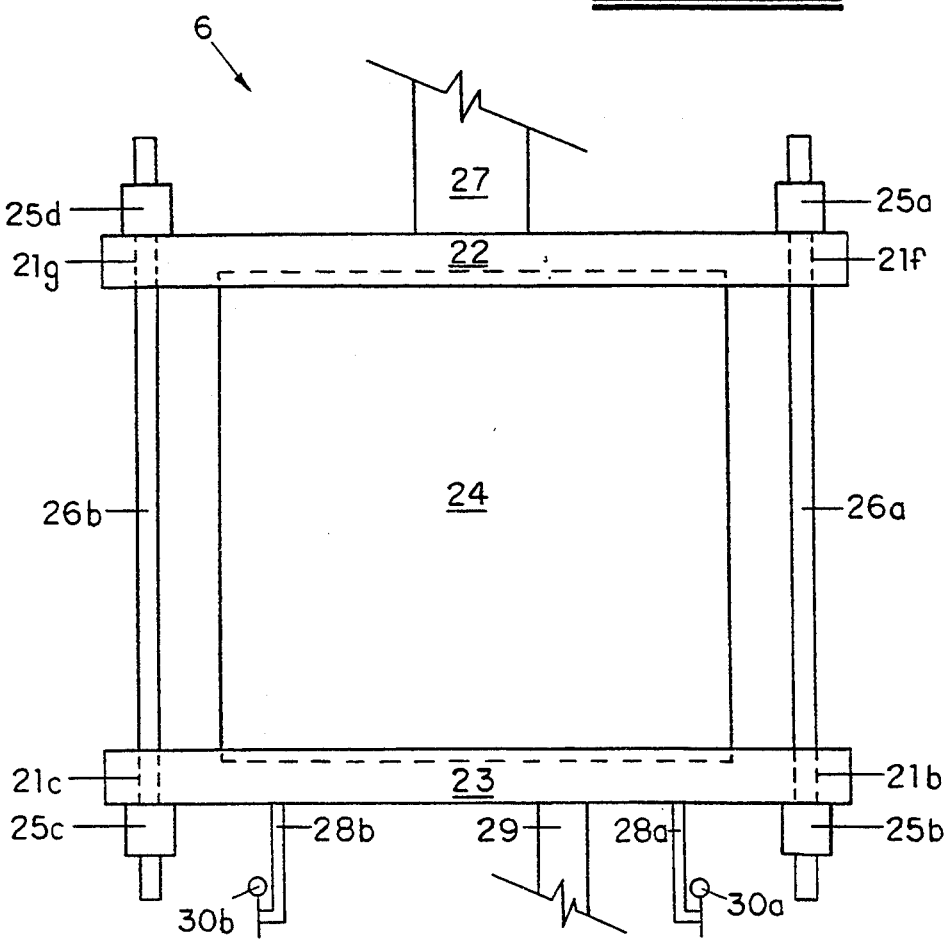
FIG. 4 is a side view of the exterior of the fine filtration system.
Figure 5:
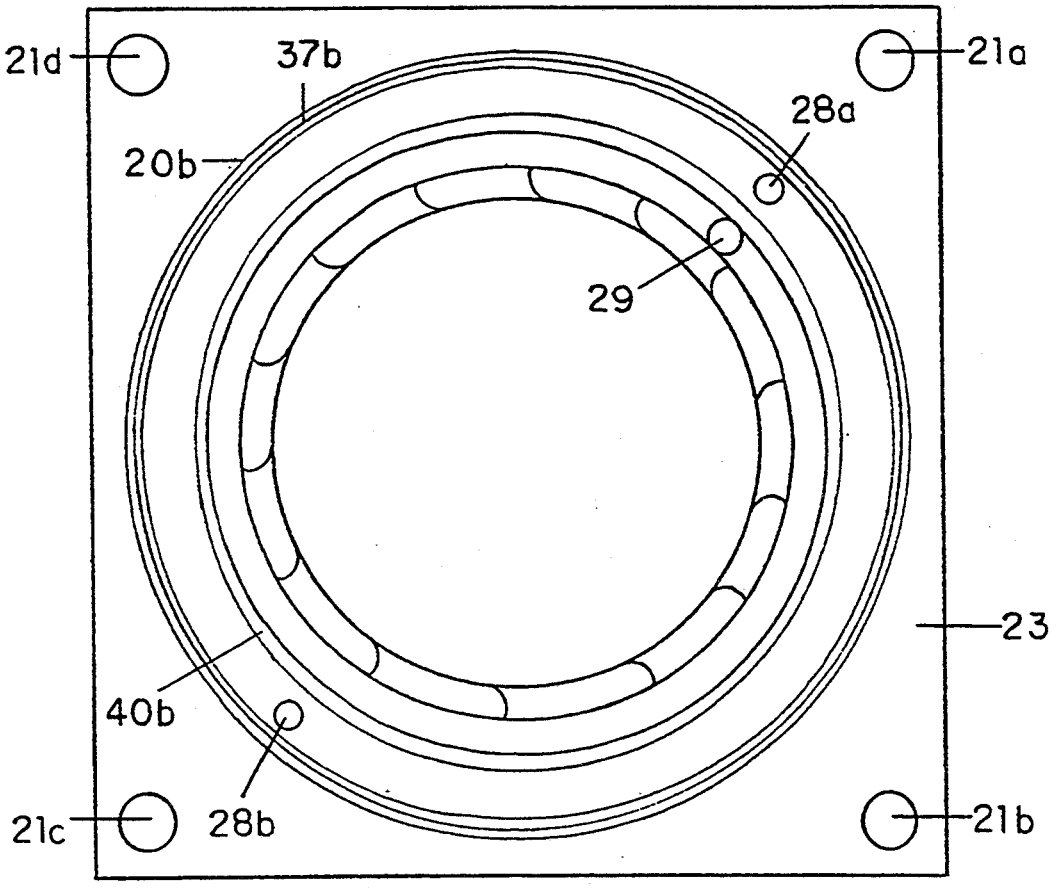
FIG. 5 is a top view of the lower plate and inner core of the fine filtration system.

Referring to FIGS. 4 and 5, the fine filtration system 6 of the present invention consists of a pressure vessel 24, upper plate 22, and lower plate 23. Pressure vessel 24 is cylindrical and fits into groove 20*a* (not shown) in the bottom side of upper plate 22 and groove 20*b* in the upper side of lower plate 23 (see FIG. 5). O-rings 37*a–b* (37*a* not shown) are placed between grooves 20*a–b* (20*a* not shown) and pressure vessel 24 to help withstand the force and pressure inside pressure vessel 24 caused by the particle/liquid mixture. Upper plate 22 and lower plate 23 are held in place by nuts 25*a–d* (FIG. 4) and 25*e–h* (not shown) screwed onto shafts 26*a–b* (FIG. 4) and 26*c–d* (not shown) which pass through shaft holes 21*a–d* (FIG. 5) and 21*f–g* (FIG. 4) and 21*e* and 21*h* (not shown).

Figure 6:
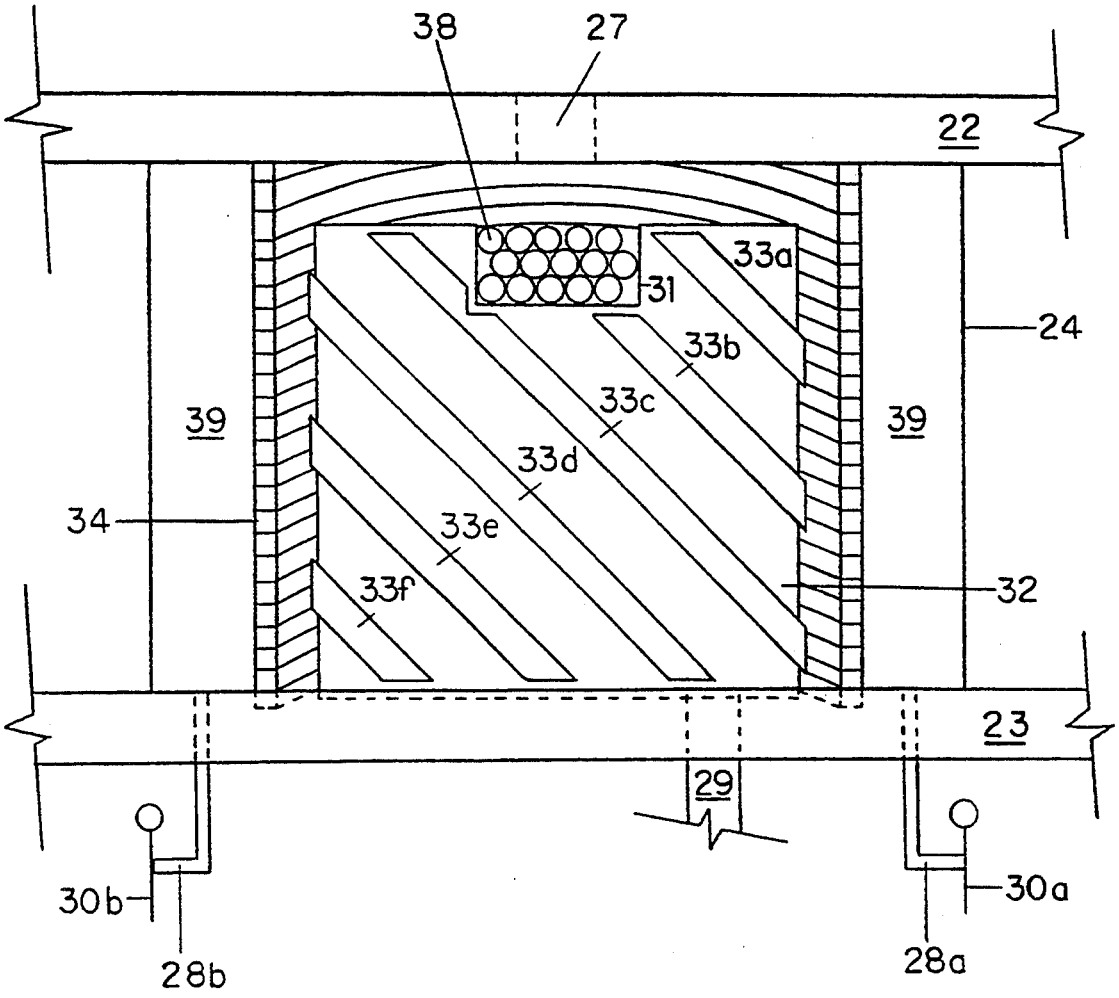
FIG. 6 is a side view of the interior of the pressure vessel of the fine filtration system.

FIG. 6 illustrates the interior design of pressure vessel 24. Within pressure vessel 24 is core 32 with a recessed impact area 31 filled with sand particles 38. The bottom edge of core 32 is securely attached to lower plate 23. Surrounding core 32 is screen 34. To retain screen 34 in place, the bottom edge of screen 34 is fitted into screen groove 40*b* in the upper side of lower plate 23 (FIG. 5). To complete the seal between screen 34 and lower plate 23, an o-ring (not shown) is placed between screen groove 40*b* and screen 34. The upper edge of screen 34 is retained by upper plate 22 in the same manner, although not shown. Due to the design of fine filtration system 6, screen 34 can be removed and replaced with a different screen if it is worn or if a smaller or larger screen size is required by unscrewing nuts 25*a, d, e* and *h* and removing upper plate 22.

The exterior of core 32 has blade-like projections 33*a–f* which help propel the particle/liquid mixture against screen 34 by centrifugal force. Fines and some liquid are forced through screen 34 by projections 33*a–f* but most of the fines and some liquid are drawn through screen 34 into fine collection area 39 by the controlled action of chokes 30*a–b* attached to fine outlet pipes 28*a–b*. Chokes 30*a–b* control the opening and closing of fine outlet pipes 28*a–b*. Chokes 30*a–b* open fine outlet pipes 28*a–b* to cause a pressure differential across screen 34 with the lower pressure in fine collection area 39. This pressure differential causes the fines and some liquid to be drawn through screen 34 into fine collection area 39 and out of pressure vessel 24 through outlet pipes 28*a–b*. The particle/liquid mixture not drawn through screen 34 exits pressure vessel 24 through outlet pipe 29.

Referring to FIG. 6, the particle/liquid mixture is deposited in pressure vessel 24 through inlet pipe 27. As the particle/liquid mixture enters pressure vessel 24 it contacts impact area 31 and sand particles 38. Impact area 31 and sand particles 38 help reduce damage to core 32 due to the force the particle/liquid mixture exerts on core 32 as it is deposited into pressure vessel 24 through inlet pipe 27. The particle/liquid mixture spills over the top edge of core 32 after contacting impact area 31 of core 32 and proceeds down through projections 33*a–f* which cause the particle/liquid mixture to swirl with centrifical force. Projections 33*a–f* propel the particle/liquid mixture against screen 34. Some fines and liquid are forced through screen 34 by projections 33*a–f*, but most of the fines and some liquid is drawn through screen 34 into fine collection area 39 by the pressure differential created by chokes 30*a–b* as previously discussed. The fines and liquid that are either forced through or drawn through screen 34 exits pressure vessel 24 through outlet pipes 28*a–b*. The remainder of the particle/liquid mixture that is not forced or drawn through screen 34 exit pressure vessel 24 through outlet pipe 29 and proceeds to well 7 in FIG. 1 and well 18 in FIGS. 2 and 3.

Chokes 30*a–b* control the opening and closing of outlet pipes 28*a–b*. As discussed above, outlet pipes 28*a–b* are normally open while the particle/liquid mixture is passing through pressure vessel 24. Outlet pipes 28*a–b* can also be open while the system is being flushed at the beginning and end of the gravel packing or fracturing processes. This would also allow for the fine filtration system 6 to be used to filter smaller particles during these flushing periods.

Outlet pipes 28*a–b* are normally closed while either the gravel packing fluid or fracturing fluid without particulates is being forced into the well. This assures that none of this material is inadvertently pushed or drawn through screen 34 and released from the system through outlet pipes 28*a–b*. Of course, the rate of particulate placement into the liquid, and/or the size of outlet pipes 28*a–b*, would ultimately determine whether or not it would even be necessary to close outlet pipes 28*a–b*. If outlet pipes 28*a–b* are of a small enough circumference, and the injection rate is sufficiently high, the outlet pipes 28*a–b* would not be required to be closed off because the pressure would be retained throughout the gravel packing process system 10 in FIG. 1 or fracturing process system 9 in FIGS. 2–3. On the other hand, if the rate of particulate placement is not sufficiently high, outlet pipes 28*a–b* should be closed to avoid a drop in pressure after the particulate/liquid mixture has passed through fine filtration system 6.

Pressure vessel 24, upper plate 22, lower plate 23, core 32, nuts 25*a–h*, shafts 26*a–d*, inlet pipe 27, and outlet pipe 29 are made of hard and durable materials such as, but not limited to, copper, stainless steel, or plastic copolymers. Screen 34 can be constructed of, although not limited by, stainless steel or other materials used for constructing screens currently used in the gravel packing process.

Of course, the embodiment of the invention as reflected in FIGS. 4–6 could be modified to produce the size of separator required. In addition, outlet pipe 29 could be connected to other fine filtration systems or other types of separators in parallel or series to obtain a more thorough separation.

I claim:

1. An improved method of gravel packing or fracturing a subterranean well, wherein a particle/liquid mixture is forced into or against a formation by a high pressure, high volume pump, the improvement comprising:

filtering said particle/liquid mixture after it has passed through said high pressure, high volume pump to effectuate removal of fines created by said pump.

2. An improved method of fracturing a subterranean well, wherein fracturing chemicals are added to a particle/liquid mixture before said particle/liquid mixture is forced into a formation by a high pressure, high volume pump, the improvement comprising:

adding said fracturing chemicals to said particle/liquid mixture after said mixture has passed through said high pressure, high volume pump; and filtering said particle/liquid mixture before said fracturing chemicals are added to effectuate removal of fines created by said pump.

* * * * *